US007927114B2

(12) United States Patent
Li et al.

(10) Patent No.: US 7,927,114 B2
(45) Date of Patent: Apr. 19, 2011

(54) CARD EDGE CONNECTOR HAVING ADDITIONAL GROUND CONTACT FACILITATING GROUNDING OF INSERTED MEMORY MODULE

(75) Inventors: Hua Li, Kunshan (CN); Zhen-Hua Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/684,978

(22) Filed: Jan. 11, 2010

(65) Prior Publication Data

US 2010/0248517 A1 Sep. 30, 2010

(30) Foreign Application Priority Data

Mar. 27, 2009 (CN) ..... 2009 2 0301671

(51) Int. Cl.
*H01R 13/648* (2006.01)

(52) U.S. Cl. ..... 439/108; 439/326

(58) Field of Classification Search ..... 439/328, 439/326, 637, 540.1, 64, 92, 676, 108
See application file for complete search history.

(56) References Cited

U.S. PATENT DOCUMENTS

| | | | | |
|---|---|---|---|---|
| 5,730,609 | A * | 3/1998 | Harwath | 439/108 |
| 7,195,498 | B1 * | 3/2007 | Wang et al. | 439/83 |
| 7,497,714 | B2 * | 3/2009 | Wang | 439/328 |
| 7,556,527 | B2 * | 7/2009 | Li et al. | 439/541.5 |
| 7,771,222 | B2 * | 8/2010 | Li et al. | 439/326 |
| 2008/0160792 | A1 * | 7/2008 | Li et al. | 439/62 |
| 2010/0248517 | A1 * | 9/2010 | Li et al. | 439/327 |
| 2010/0279531 | A1 * | 11/2010 | Li | 439/159 |

* cited by examiner

*Primary Examiner* — Neil Abrams
*Assistant Examiner* — Phuongchi T Nguyen
(74) *Attorney, Agent, or Firm* — Andrew C. Cheng; Wei Te Chung; Ming Chieh Chang

(57) ABSTRACT

A card edge connector includes an elongated housing defining a plurality of first and second terminal grooves at opposite sides thereof. A key is located between said first and second terminal grooves. A plurality of first and second terminals are respectively received in said first and second terminal grooves. The outmost of the first terminal together with the outmost of the second terminal are arranged as grounding terminals and form a diagonal configuration to contact with grounding pad defined on the memory module for eliminating EMI.

9 Claims, 5 Drawing Sheets

CARD EDGE CONNECTOR HAVING ADDITIONAL GROUND CONTACT FACILITATING GROUNDING OF INSERTED MEMORY MODULE

BACKGROUND OF THE INVENTION

1. Field of the Invention Proprietorship

The present invention relates to a card edge connector, and more particularly to a card edge connector including a pair of additional grounding contacts for suppressing Electro-Magnetic Interference (EMI) for inserted memory module.

2. Description of the Related Art

Card edge connector is usually mounted onto a printed circuit board for connecting with a memory module so as to realize the signal transmission. As transmission speed between the memory module and the printed circuit board becomes faster and faster, EMI has to be properly shielded so as to prevent any inadvertent and negative impact to the transmission therebetween.

To overcome the aforementioned problem, a metallic shell is provided and to shield the card edge connector for eliminating EMI, however, the metallic shell increases the overall height of the card edge connector and increases the additional production cost. Hence, a new design which can solve the problem is required.

SUMMARY OF THE INVENTION

Accordingly, an object of the present invention is to provide a card edge connector which can effectively eliminate EMI with respect to an inserted memory module.

In order to achieve the object set forth, a card edge connector includes an elongated housing defining a plurality of first and second terminal grooves at opposite sides thereof. A key is located between said first and second terminal grooves. A plurality of first and second terminals are respectively received in said first and second terminal grooves. The outmost of the first terminal together with the outmost of the second terminal are designated as grounding terminals and form a diagonal configuration.

Other objects, advantages and novel features of the invention will become more apparent from the following detailed description of the present embodiment when taken in conjunction with the accompanying drawings.

DETAILED DESCRIPTION OF THE INVENTION

Figure 1:
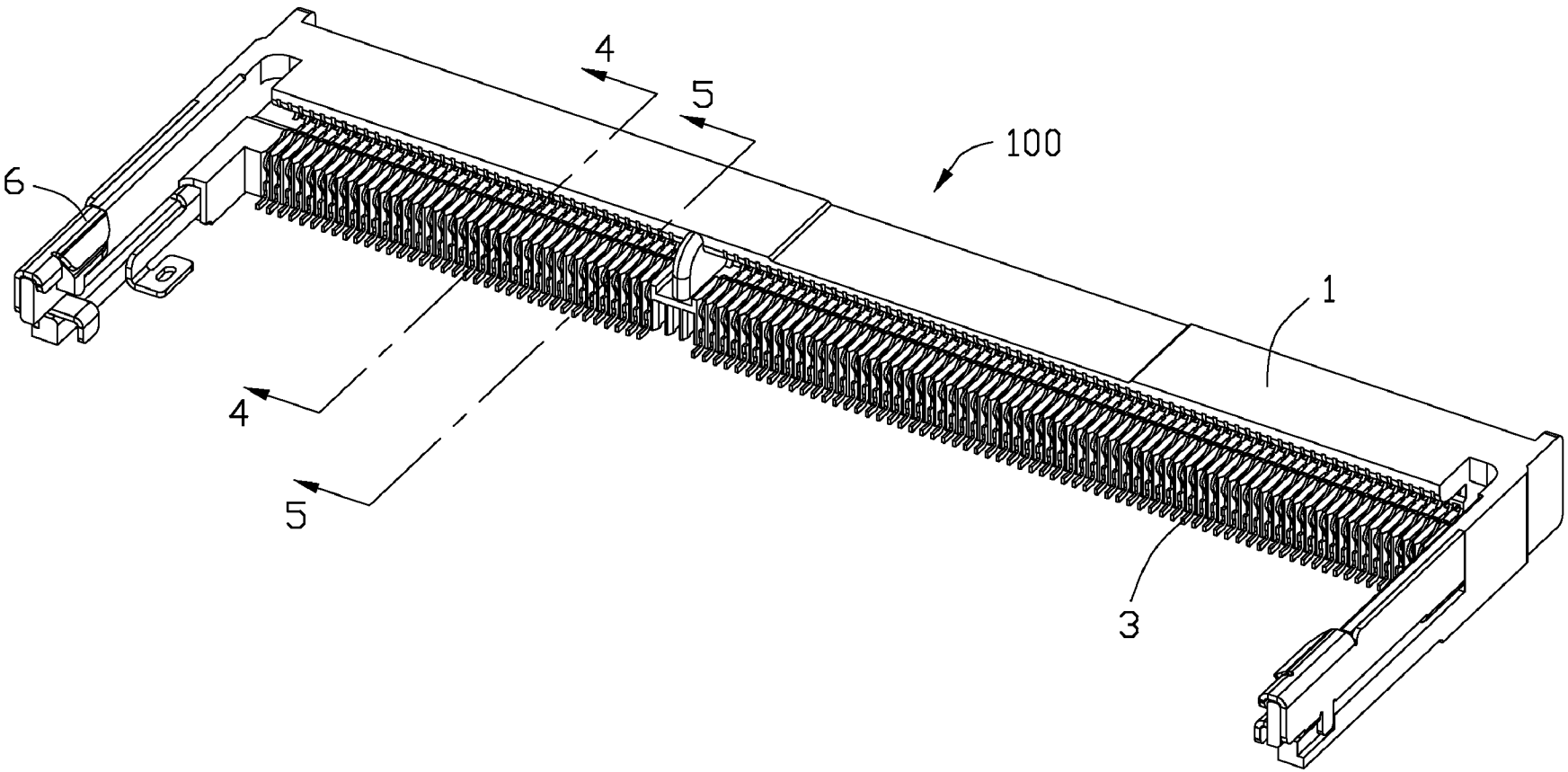
FIG. 1 is a perspective view of a card edge connector in accordance with the present invention.

Reference will now be made to the drawing figures to describe a preferred embodiment of the present invention in detail. Referring to FIG. 1, a card edge connector 100 according to the preferred embodiment of the present invention is made and comprises an insulative housing 1 with a plurality of conductive terminals 3 received therein.

Figure 2:
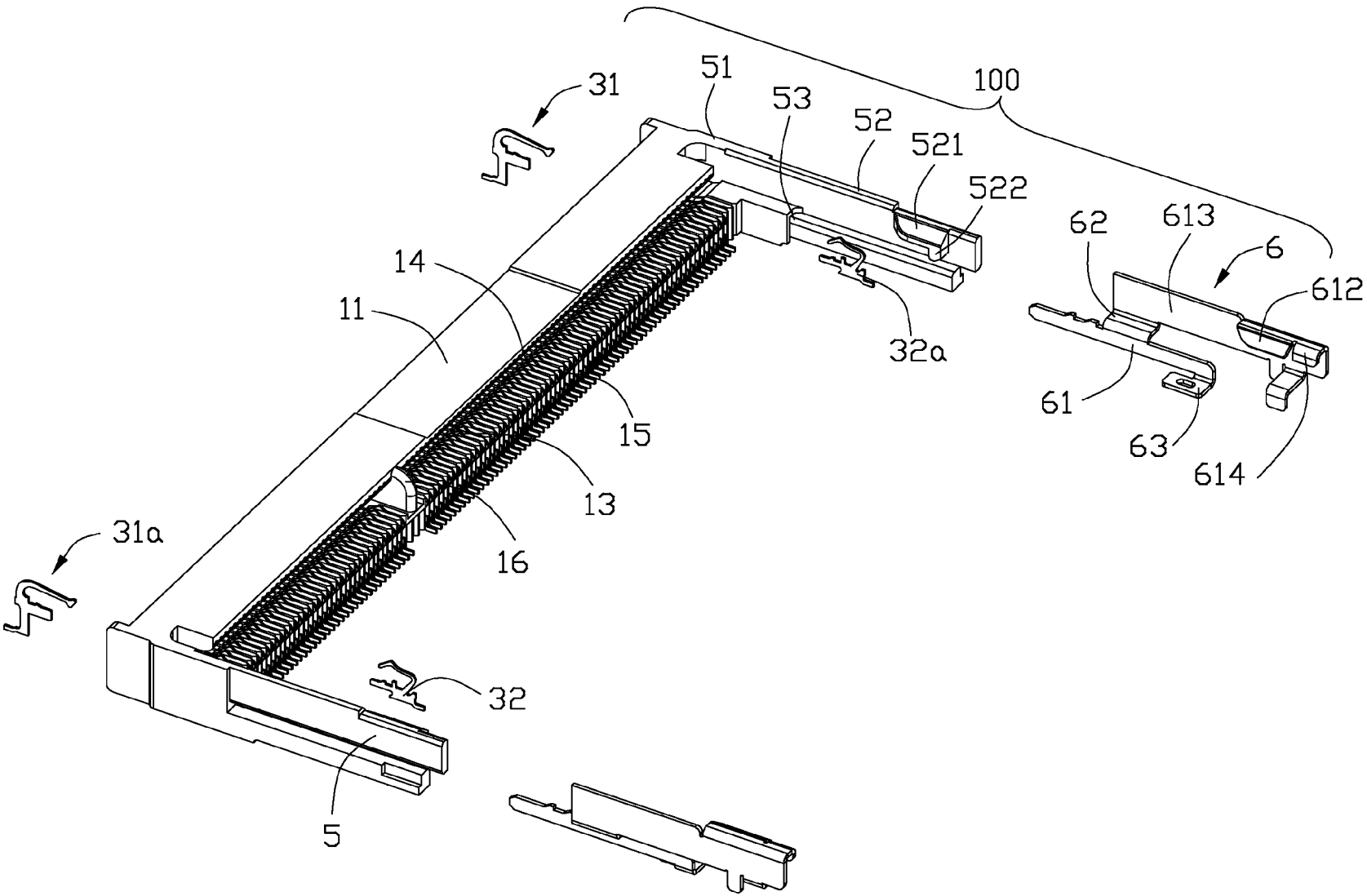
FIG. 2 is an exploded perspective view of the card edge connector shown in FIG. 1.

Referring to FIG. 2, the insulative housing 1 comprises an elongated base portion 11 and a pair of arms 5 disposed at opposite ends of the base portion 11. A mating groove 13 is defined along a longitudinal direction of the base portion 11 between the pair of arms 5 and opened forwardly for receiving a memory module therein. A pair of metallic retaining devices 6 are respectively attached onto the arms 5 for strengthening the flexibility of the arms 5 and guiding the memory module to be inserted into the mating groove 13. A plurality of receiving passageways 14, 15 are respectively defined at opposite sides of the mating groove 13 and are arranged at fixed pitch along a longitudinal direction. A key 16 is formed in the mating groove 13 adjacent to one of the arms 5 thereby dividing the mating groove 13 into two separated parts.

Each arm 5 comprises a root portion 51 jointing with the base portion 11, and two individual side arms 52, 53 separately formed and protruding forward from the root portion 51. At the end of the upper side arm 52, a locking portion 522 and a guiding portion 521 are respectively formed and arranged adjacent to each other. The retaining device 6 is made from a metal sheet and comprises a first vertical wall 61, a second vertical wall 613 parallel with the first vertical wall 61, and a connecting section 62 linking the first and second vertical walls. The first and second vertical walls 61, 613 are respectively located at inner side of the lower side wall 53 and outer side of the upper side wall 52 with the connecting section 62 sandwiched therebetween. A solder portion 63 extends from a bottom lateral edge of the first vertical wall 61. A buckling piece 614 and a guiding piece 612 respectively extend from top lateral edge of the second vertical wall 613 and bend downward to attach to the locking portion 522 and guiding portion 521 of the arm 5. When the memory module is inserted into the mating groove 13 and rotated downwardly, lateral edges of the memory module will slid along the guiding piece 612 until being locked by the locking portion 522 of the arm 5.

Figure 4:
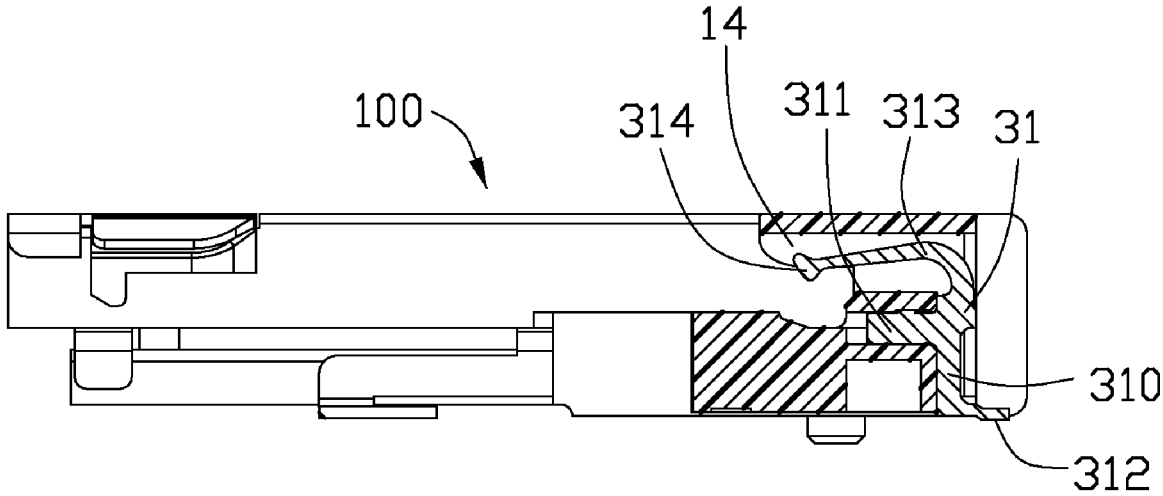
FIG. 4 is a cross sectional view of the card edge connector shown in FIG. 1 along line 4-4.
Figure 5:
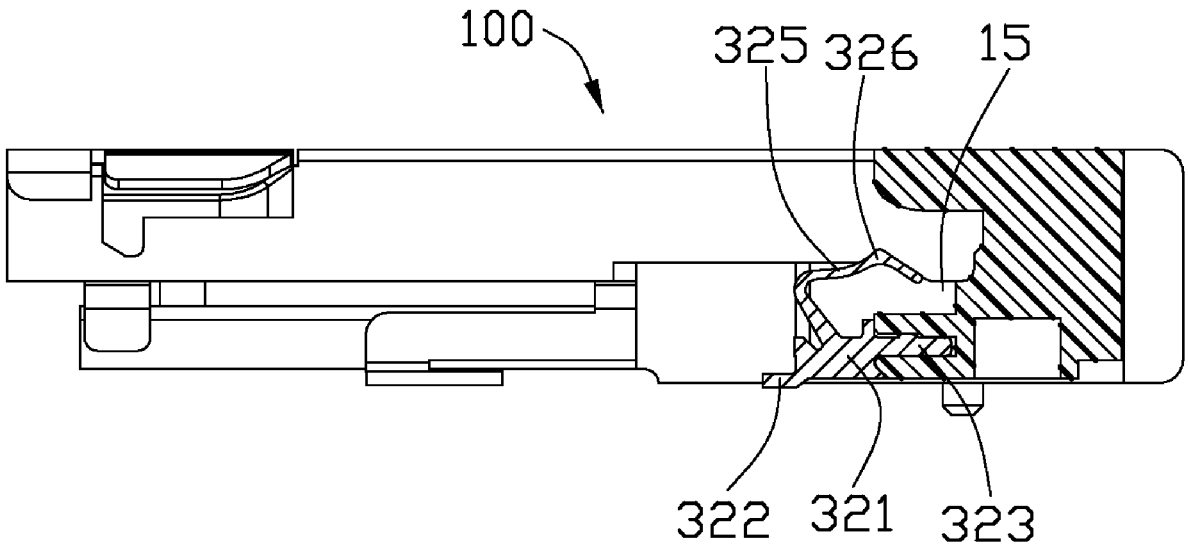
FIG. 5 is a cross sectional view of the card edge connector shown in FIG. 1 along line 5-5.

The terminals 3 comprise upper terminals 31 and lower terminals 32, which are respectively received in the receiving passageways 14, 15. Referring to FIG. 4, the upper terminals 31 are inserted into the upper receiving passageways 14 along a rear-to-front direction, and each upper terminal 31 comprises a vertical body portion 310, a retaining portion 311 extending forward from side edge of the body portion 310, a resilient arm 313 extending from top end of the body portion 310 with a contacting portion 314 at distal end thereof, and a solder portion 312 extending from bottom end of the body portion 310. The resilient arm 313 projects forward and exposes into the mating groove 13 for contacting with the memory module. Referring to FIG. 5, the lower terminals 32 are inserted into the lower receiving passageway 15 along a front-to-rear direction, and each lower terminal 32 comprises a body portion 321, a retaining portion 323 extending from lateral side of the body portion 321, a solder portion 322 extending from opposite lateral side of the body portion 321, and a resilient arm 325 extending upward and then backward from the body portion 321.

Figure 3:
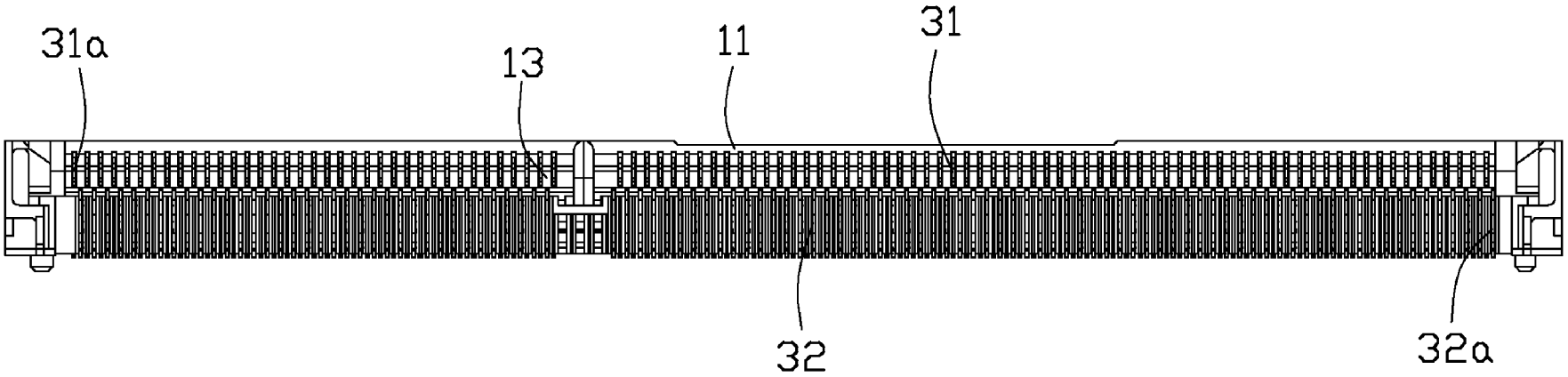
FIG. 3 is a front view of the card edge connector shown in FIG. 1.

Referring to FIGS. 2 and 3, a grounding member 31*a* which is configured as the same structure of the upper terminals 31, is arranged at the outmost of the left side of upper terminals 31, and a grounding member 32*a* which is configured as the same structure of the lower terminals 32, is arranged at the outmost of the right side of the lower terminals 32. The two grounding members 31*a*, 32*a* can be easily made according to the mass production of the terminals 3. For eliminating EMI, the memory module defines a grounding pad at the right or left side on the top face or at the right or left side on the lower face, therefore when the memory module is inserted into the mating groove 13, at least one grounding member 31*a* or 32*a* will contact with the grounding pad. As the two grounding members 31*a*, 32*a* are arranged at diagonal of the mating groove 13, no matter how the grounding pad is defined at any side or face of the memory module, the grounding pad will be reliably in contact with the grounding member for eliminating EMI, which is helpful to the signal transmission between the memory module and a printed circuit board on which the card edge connector is mounted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting a memory module to a printed circuit board comprising:

an elongated insulative housing defining a mating groove in the housing along a longitudinal direction thereof, a plurality of first and second terminal grooves defined at opposite sides of the mating groove;

a plurality of first and second terminals respectively received in the first and second terminal grooves; the first terminals are inserted into the first terminal grooves from a front-to-rear direction, while the second terminals are inserted into the second terminal grooves from a rear-to-front direction; and a pair of grounding members arranged at diagonal of the mating groove;

a pair of metallic retaining devices are respectively attached onto the arms for strengthening the flexibility of the arms and guiding the memory module to be inserted into the mating groove;

each arm comprises a root portion jointing with the base portion, and upper and lower side arms, separately formed and protruding forward from the root portion; a locking portion and a guiding portion are respectively formed and arranged adjacent to each other at the end of the upper side arm;

the retaining device comprises a connecting section linking first and second vertical walls; the first and second vertical walls are respectively located at inner side of the lower side wall and outer side of the upper side wall with the connecting section sandwiched therebetween;

a solder portion extends from a bottom lateral edge of the first vertical wall; a buckling piece and a guiding piece respectively extend from top lateral edge of the second vertical wall and bend downward to attach to the locking portion and guiding portion of the arm.

2. The card edge connector as described in claim 1, wherein the grounding members are respectively received in the first and second terminal grooves.

3. The card edge connector as described in claim 2, wherein the grounding member in the first terminal groove is configured same as the first terminals, and the grounding member in the second terminal groove is configured same as the second terminals.

4. The card edge connector as described in claim 1, wherein; a grounding member which is configured as the same structure of the upper terminals, is arranged at the outmost of the left side of upper terminals.

5. The card edge connector as described in claim 4, wherein a pair of arms are disposed at opposite ends of the mating groove, the grounding members are adjacent to said arms.

6. A card edge connector comprising: an elongated housing defining a plurality of first and second terminal grooves at opposite sides thereof, and a key located between said first and second terminal grooves; and a plurality of contacts arranged in first and second rows respectively by two sides of the receiving slot along said lengthwise direction under condition that the contacts in the first row are different from the contacts in the second row both in shape and in dimension;

first and second deflectable latches located at two opposite ends of the housing in said lengthwise direction, each of said first and second deflectable latches being equipped with a metallic piece for reinforcement of strength thereof;

a plurality of first and second terminals respectively received in said first and second terminal grooves; wherein the outmost of the first terminal together with the outmost of the second terminal are arranged as grounding terminals and form a diagonal configuration;

said first latch further includes a plastic piece supported by the metallic piece and formed with a locking portion thereon for locking an edge card whose bottom edge is adapted to be received in said receiving slot; a locking portion and a guiding portion are respectively formed and arranged adjacent to each other at the end of an upper side latch;

a solder portion extends from a bottom lateral edge of a first vertical wall; a buckling piece and a guiding piece respectively extend from top lateral edge of a second vertical wall and bend downward to attach to the locking portion and guiding portion of the arm.

7. The card edge connector as described in claim 6, wherein a pair of arms are disposed at opposite ends of the housing, and said grounding terminals are adjacent to the arms.

8. A card edge connector comprising:

an elongated insulaitve housing extending along a lengthwise direction with a receiving slot extending along said lengthwise direction;

a plurality of contacts arranged in first and second rows respectively by two sides of the receiving slot along said lengthwise direction under condition that the contacts in the first row are different from the contacts in the second row both in shape and in dimension;

first and second deflectable latches located at two opposite ends of the housing in said lengthwise direction, each of said first and second deflectable latches being equipped with a metallic piece for reinforcement of strength thereof;

one outermost contact in the first row in said lengthwise direction being the closest one of all said contacts in both said first and second rows with regard to the first latch; and another outermost contact in the second row in said longwise direction being the closest one of all said contacts in both said first and second rows with regard to the second latch; wherein both said outermost contact and said another outermost contact are grounding contacts corresponding to the metallic pieces of said first and second latches, respectively;

said first latch further includes a plastic piece supported by the metallic piece and formed with a locking portion thereon for locking an edge card whose bottom edge is adapted to be received in said receiving slot; a locking portion and a guiding portion are respectively formed and arranged adjacent to each other at the end of an upper side latch;

a solder portion extends from a bottom lateral edge of a first vertical wall; a buckling piece and a guiding piece respectively extend from top lateral edge of a second vertical wall and bend downward to attach to the locking portion and guiding portion of the upper side latch.

9. The card edge connector as claimed in claim 8, wherein;

a grounding member which is configured as the same structure of the upper terminals, is arranged at the outmost of the left side of upper terminals.

* * * * *